US011390489B2

(12) United States Patent
He et al.

(10) Patent No.: US 11,390,489 B2
(45) Date of Patent: Jul. 19, 2022

(54) MINE VERTICAL SHAFTLIFTING APPARATUS, MINE VERTICAL SHAFT LIFTING SYSTEM AND CONTROL METHOD THEREFOR

(71) Applicant: China University of Mining & Technology, Beijing, Beijing (CN)

(72) Inventors: Manchao He, Beijing (CN); Guohua Cao, Beijing (CN); Xiaoming Sun, Beijing (CN); Jun Yang, Beijing (CN)

(73) Assignee: CHINA UNIVERSITY OF MINING & TECHNOLOGY, BEIJING, Beijing (CN)

( * ) Notice: Subject to any disclaimer, the term of this patent is extended or adjusted under 35 U.S.C. 154(b) by 0 days.

(21) Appl. No.: 17/289,535

(22) PCT Filed: Oct. 31, 2018

(86) PCT No.: PCT/CN2018/112937
§ 371 (c)(1),
(2) Date: Apr. 28, 2021

(87) PCT Pub. No.: WO2020/087333
PCT Pub. Date: May 7, 2020

(65) Prior Publication Data

US 2021/0309489 A1 Oct. 7, 2021

(51) Int. Cl.
*B66B 7/10* (2006.01)
*B66B 15/06* (2006.01)
(Continued)

(52) U.S. Cl.
CPC ..... *B66B 7/10* (2013.01); *B66B 15/06* (2013.01); *B66B 15/08* (2013.01); *B66B 17/12* (2013.01); *B66B 17/04* (2013.01)

(58) Field of Classification Search
CPC ..... B66B 7/10; B66B 15/06; B66B 15/08; B66B 17/12; B66B 17/04
(Continued)

(56) References Cited

U.S. PATENT DOCUMENTS 3,604,684 A * 9/1971 Eithun ..... B66B 15/06 254/319
4,522,285 A 6/1985 Hiller et al.
(Continued)

FOREIGN PATENT DOCUMENTS

AU 2014277625 B9 12/2015
CN 1245324 C 3/2006
(Continued)

OTHER PUBLICATIONS

International Search Report issued in PCT/CN2018/112937 dated Jun. 12, 2019, pp. 1-6.
(Continued)

*Primary Examiner* — Jeffrey Donels
(74) *Attorney, Agent, or Firm* — Arentfox Schiff LLP

(57) ABSTRACT

A hoisting apparatus for a mine vertical shaft, a hoisting system for a mine vertical shaft and a controlling method thereof are provided. The hoisting apparatus includes a driving device provided at a wellhead and a guiding device provided in a vertical shaft. A position of the guiding device corresponds to a position of the driving device and a transmission rope is wound around the driving device and the guiding device. Moreover, the driving device is drivingly connected to the guiding device via the transmission rope; and a tension regulating device is provided in the vertical shaft. The guiding device is movably provided at the tension regulating device that is for regulating a distance between the driving device and the guiding device. The tension regulating device controls a tension of the transmission rope
(Continued)

by regulating the distance between the driving device and the guiding device.

14 Claims, 3 Drawing Sheets

(51) Int. Cl.
*B66B 15/08* (2006.01)
*B66B 17/12* (2006.01)
*B66B 17/04* (2006.01)

(58) Field of Classification Search
USPC ..... 187/266
See application file for complete search history.

(56) References Cited

U.S. PATENT DOCUMENTS

| | | | | |
|---|---|---|---|---|
| 5,788,018 | A | 8/1998 | Mendelsohn et al. | |
| 5,861,084 | A | 1/1999 | Barker et al. | |
| 8,162,110 | B2 * | 4/2012 | Smith | B66B 1/3484 187/393 |
| 8,297,348 | B2 | 10/2012 | Robichaux et al. | |
| 2014/0110194 | A1 * | 4/2014 | Zhu | B66B 17/04 187/254 |
| 2015/0298939 | A1 | 10/2015 | Lampinen | |
| 2018/0013278 | A1 * | 1/2018 | Wang | F15B 13/0401 |
| 2021/0053805 | A1 * | 2/2021 | Zhen | B66B 15/08 |
| 2021/0070586 | A1 * | 3/2021 | Shen | B66B 1/28 |

FOREIGN PATENT DOCUMENTS

| | | | |
|---|---|---|---|
| CN | 101195457 | A | 6/2008 |
| CN | 203568650 | U | 4/2014 |
| CN | 106966252 | A | 7/2017 |
| CN | 107128784 | A | 9/2017 |
| CN | 108083046 | A | 5/2018 |
| CN | 108584617 | A | 9/2018 |
| JP | H11106160 | A | 4/1999 |
| JP | 2012035971 | A | 2/2012 |
| RU | 2523302 | C2 | 7/2014 |
| SU | 956406 | A1 | 9/1982 |
| SU | 1020341 | A1 | 5/1983 |
| SU | 1423485 | A1 | 9/1988 |

OTHER PUBLICATIONS

Written Opinion of the International Searching Authority issued in PCT/CN2018/112937 dated Jun. 12, 2019, pp. 1-7.
Australian Examination report No. 1 dated Jun. 30, 2021 issued in corresponding Australian Patent Application No. 2018448166.
Russian Office Action dated Dec. 2, 2021 issued in Russian counterpart application No. 2021112371.

* cited by examiner

MINE VERTICAL SHAFTLIFTING APPARATUS, MINE VERTICAL SHAFT LIFTING SYSTEM AND CONTROL METHOD THEREFOR

CROSS REFERENCE TO RELATED APPLICATIONS

This application is a U.S. National Stage entry under 35 U.S.C. § 371 based on International Application No. PCT/CN2018/112937, filed on Oct. 31, 2018, which was published under PCT Article 21(2). The embodiment of the priority applications are hereby incorporated herein in their entirety by reference.

TECHNICAL FIELD

The present disclosure relates to the technical field of mine vertical shaft hoisting, and in particular to a hoisting apparatus for a mine vertical shaft, a hoisting system for a mine vertical shaft and a controlling method thereof.

BACKGROUND

In the existing multi-rope-friction hoisting systems for vertical shafts, due to the heavy load and the high speed of the hoisting equipment, in the process of high-speed winding of the hoisting steel-wire rope, static displacement will be generated at the bottom of the transmission rope of the hoisting system, which causes the tension of the guiding wheel to fluctuate cyclically and has a negative impact on the life of the transmission rope of the hoisting system. At present, in the vertical-shaft multi-rope-friction hoisting systems used in ultra-deep wells, a regulating system that can guarantee the constant tension of the hoisting rope is very rare.

Therefore, in view of the above existing technique, how to design a tension regulating system with simple structure, self-adapting regulation, high regulation sensitivity, and good effect has become a problem to be considered and solved by those skilled in the art.

SUMMARY

In order to solve the above technical problems, the present disclosure discloses a hoisting apparatus for a mine vertical shaft, a hoisting system for a mine vertical shaft and a controlling method thereof, which solve the problem of the existing hoisting systems that static displacement will be generated at the bottom of the transmission rope, which causes the tension of the guiding wheel to fluctuate cyclically.

According to an aspect of the present disclosure, a hoisting apparatus for a mine vertical shaft is disclosed, comprising: a driving device provided at a wellhead; a guiding device provided in a vertical shaft, wherein a position of the guiding device corresponds to a position of the driving device; a transmission rope wound around the driving device and the guiding device, wherein the driving device is drivingly connected to the guiding device via the transmission rope; and a tension regulating device provided in the vertical shaft, wherein the guiding device is movably provided at the tension regulating device, and the tension regulating device is for regulating a distance between the driving device and the guiding device and the tension regulating device controls a tension of the transmission rope by regulating the distance between the driving device and the guiding device.

Optionally, the tension regulating device comprises a hydraulic device, the hydraulic device comprises a hydraulic cylinder and a piston rod engaged with the hydraulic cylinder, the hydraulic cylinder of the hydraulic device is fixedly provided in the vertical shaft, and a free end of the piston rod of the hydraulic device is fixedly connected to the guiding device.

Optionally, there are two hydraulic devices, and the two hydraulic devices are provided oppositely at two ends of the guiding device.

Optionally, the hydraulic cylinders of the two hydraulic devices are communicated with each other via an oil pipe.

Optionally, the driving device comprises: a hoisting drum provided above the wellhead, wherein part of the transmission rope is wound around the hoisting drum; and an electric motor drivingly connected to the hoisting drum.

Optionally, the guiding device comprises: a bearing seat provided at the tension regulating device; a guiding wheel axle rotatably provided in the bearing seat; and a guiding wheel nested to the guiding wheel axle, wherein part of the transmission rope is wound around the guiding wheel.

Optionally, the two hydraulic devices are respectively provided at two ends of the guiding wheel axle, and a free end of the piston rod is fixedly connected to the bearing seat.

Optionally, the transmission rope comprises: a hoisting steel-wire rope wound around the driving device, wherein the hoisting steel-wire rope has a first end and a second end, the first end of the hoisting steel-wire rope is fixedly connected to a counterweight container, and the second end of the hoisting steel-wire rope is fixedly connected to a hoisting container; and a tail rope wound around the guiding device, wherein the tail rope has a first end and a second end, the first end of the tail rope is fixedly connected to the counterweight container, the second end of the tail rope is fixedly connected to the hoisting container, and the hoisting steel-wire rope, the tail rope, the counterweight container and the hoisting container are connected to form a ring-shaped transmission structure.

Optionally, there are a plurality of transmission ropes, the plurality of transmission ropes are wound around the driving device and the guiding device, and the plurality of transmission ropes are provided at intervals.

According to another aspect of the present disclosure, a hoisting system for a mine vertical shaft is disclosed, comprising: the above-described hoisting apparatus for a mine vertical shaft; a tension detecting device configured to obtain an actual tension value of the transmission rope; and a tension controlling device connected to the tension regulating device and the tension detecting device and configured to control the tension regulating device.

According to another aspect of the present disclosure, a method for controlling the above-described hoisting system for a mine vertical shaft is disclosed, comprising the following steps: step S10: obtaining an actual tension value F1 of the transmission rope and obtaining a preset tension value F0; and step S20: controlling the tension regulating device to adjust the distance between the driving device and the guiding device according to the actual tension value F1 and the preset tension value F0.

Optionally, the step S20 comprises the following steps: step S21: when F1>F0, controlling the tension regulating device to reduce the distance between the driving device and the guiding device, to reduce the tension of the transmission rope; and step S22: when F1<F0, controlling the tension regulating device to increase the distance between the driving device and the guiding device, to increase the tension of the transmission rope.

Optionally, the step S20 further comprises the following step: step S23: when the actual tension value F1 is equal to the preset tension value F0, keeping, by the tension regulating device, the distance between the driving device and the guiding device unchanged.

According to another aspect of the present disclosure, a hoisting system for a mine vertical shaft is disclosed, comprising: the above-described hoisting apparatus for a mine vertical shaft; a pressure detecting device provided in the hydraulic cylinder of the hydraulic device and configured to obtain an actual pressure value P1 in the hydraulic cylinder; and a pressure controlling device connected to the hydraulic device and the pressure detecting device and configured to control the hydraulic device.

According to another aspect of the present disclosure, a method for controlling the above-described hoisting system for a mine vertical shaft is disclosed, comprising the following steps: step S10: obtaining an actual pressure value P1 in the hydraulic cylinder and obtaining a preset pressure value P0; and step S20: controlling the hydraulic device to adjust the distance between the driving device and the guiding device according to the actual pressure value P1 and the preset pressure value P0.

Optionally, the step S20 comprises the following steps: step S21: when P1>P0, controlling the hydraulic device to reduce the distance between the driving device and the guiding device, to reduce the tension of the transmission rope; and step S22: when P1<P0, controlling the hydraulic device to increase the distance between the driving device and the guiding device, to increase the tension of the transmission rope.

Optionally, the step S20 further comprises the following step: step S23: when the actual pressure value P1 is equal to the preset pressure value P0, keeping, by the hydraulic device, the distance between the driving device and the guiding device unchanged.

In the present disclosure, by arranging the guiding device on the tension regulating device, the distance between the driving device and the guiding device can be regulated by using the tension regulating device, and the tension of the transmission rope can be controlled by regulating the distance between the driving device and the guiding device, so as to realize the real-time regulation of the tension of the transmission rope to a constant value during the whole lifting process effectively, thereby reducing the tension fluctuation generated during the operation of the hoisting system and improving the safety of the hoisting system.

Figure 1:
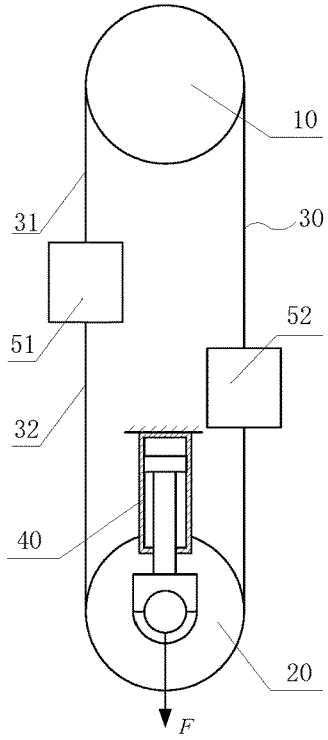
FIG. 1 is a schematic diagram of the structure of the hoisting apparatus for a mine vertical shaft according to an embodiment of the present disclosure.
Figure 2:
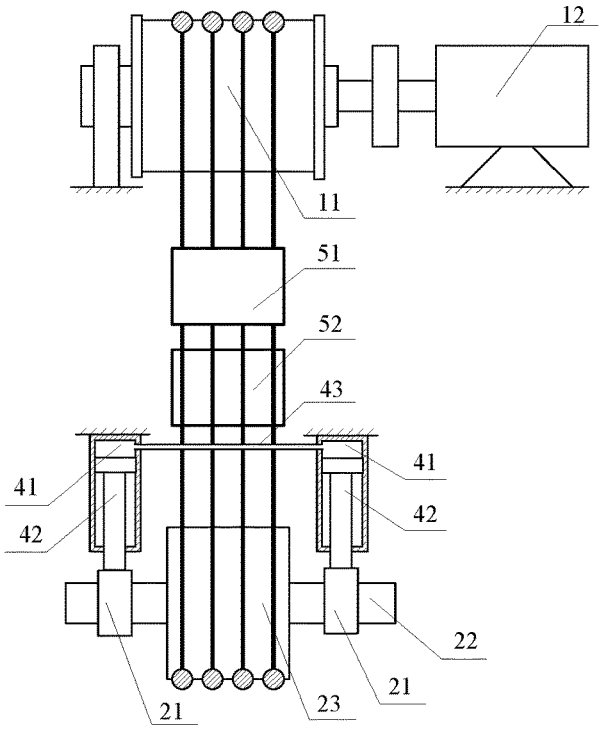
FIG. 2 is a side view of a schematic diagram of the structure of the hoisting apparatus for a mine vertical shaft according to an embodiment of the present disclosure.
Figure 3:
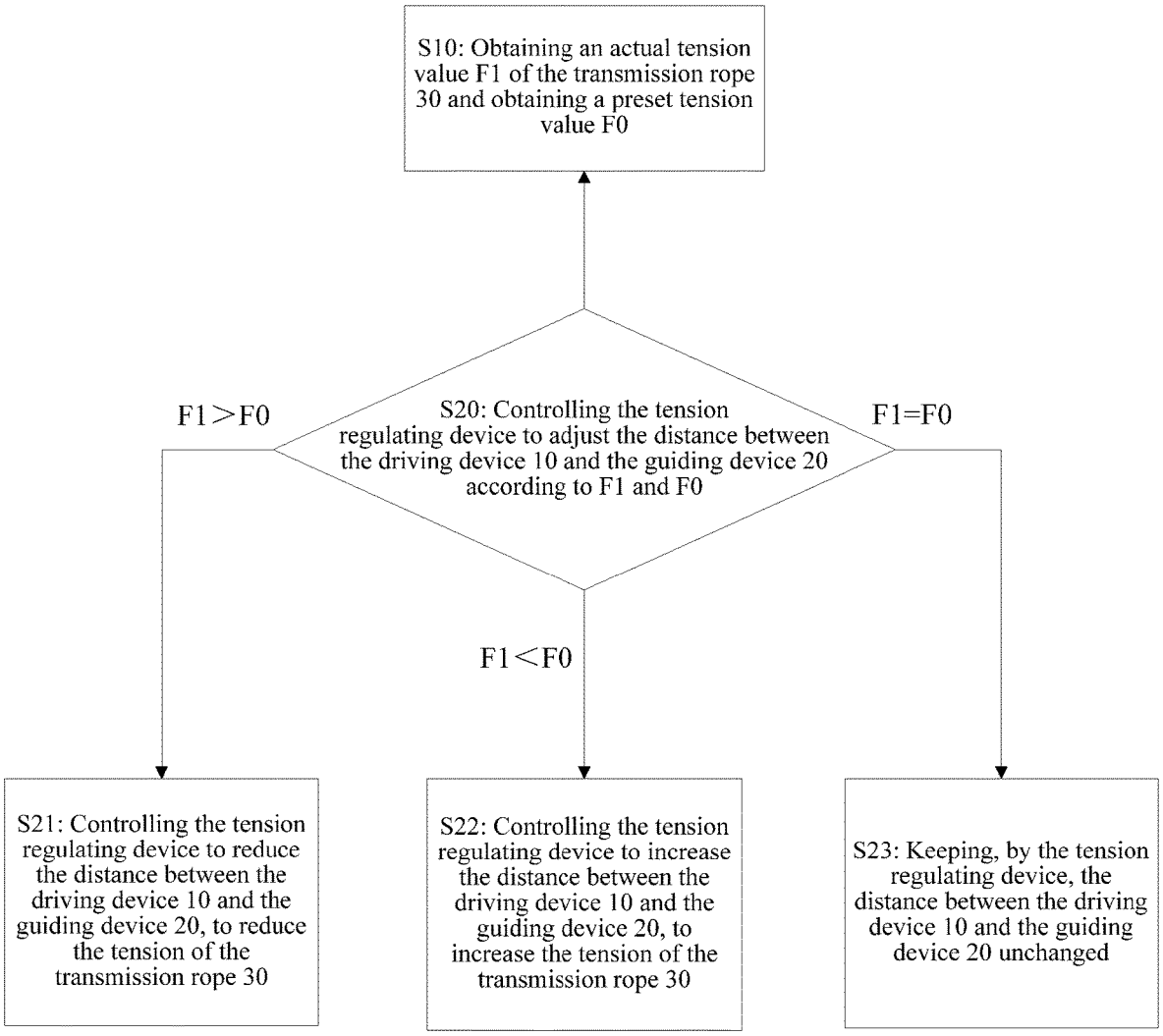
FIG. 3 is a diagram of the working principle of the hoisting system for a mine vertical shaft according to an embodiment of the present disclosure.
Figure 4:
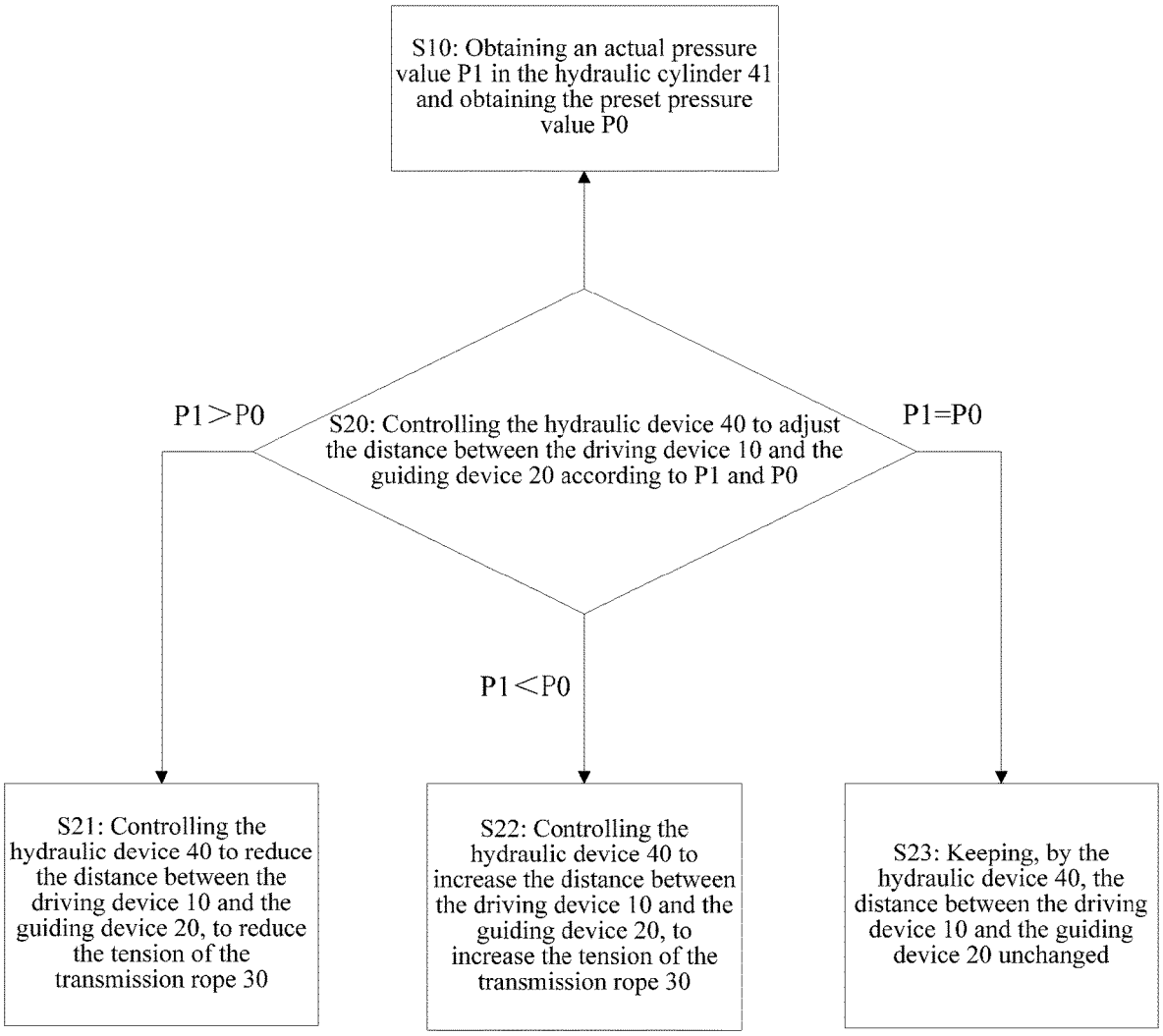
FIG. 4 is a diagram of the working principle of the hoisting system for a mine vertical shaft according to another embodiment of the present disclosure.

In the drawings: 10, driving device; 11, hoisting drum; 12, electric motor; 20, guiding device; 21, bearing seat; 22, guiding wheel axle; 23, guiding wheel; 30, transmission rope; 31, hoisting steel-wire rope; 32, tail rope; 40, hydraulic device; 41, hydraulic cylinder; 42, piston rod; 43, oil pipe; 51, counterweight container; and 52, hoisting container.

DETAILED DESCRIPTION

The present disclosure will be further described below in conjunction with embodiments, but it is not limited to the contents of the description.

The present disclosure discloses a hoisting apparatus for a mine vertical shaft comprising: a driving device 10, a guiding device 20, a transmission rope 30 and a tension regulating device. The driving device 10 is provided at the wellhead. The guiding device 20 is provided in a vertical shaft, and the position of the guiding device 20 corresponds to the position of the driving device 10. The transmission rope 30 is wound around the driving device 10 and the guiding device 20, and the driving device 10 is drivingly connected to the guiding device 20 via the transmission rope 30. A tension regulating device is provided in the vertical shaft, and the guiding device 20 is movably provided at the tension regulating device. The tension regulating device is used for regulating the distance between the driving device 10 and the guiding device 20, and controls the tension of the transmission rope 30 by regulating the distance between the driving device 10 and the guiding device 20.

In the present disclosure, by arranging the guiding device 20 on the tension regulating device, the distance between the driving device 10 and the guiding device 20 can be regulated by using the tension regulating device, and the tension of the transmission rope 30 can be controlled by regulating the distance between the driving device 10 and the guiding device 20, so as to realize the real-time regulation of the tension of the transmission rope 30 to a constant value during the whole lifting process effectively, thereby reducing the tension fluctuation generated during the operation of the hoisting system and improving the safety of the hoisting system.

In the above embodiment, the tension regulating device comprises a hydraulic device 40. The hydraulic device 40 comprises a hydraulic cylinder 41 and a piston rod 42 engaged with the hydraulic cylinder 41. The hydraulic cylinder 41 of the hydraulic device 40 is fixedly provided in the vertical shaft. The free end of the piston rod 42 of the hydraulic device 40 is fixedly connected to the guiding device 20. During the lifting process, as the lifting height increases, the static displacement at the bottom of the hoisting apparatus changes all the time, and its tension also changes all the time. The hydraulic device 40 adjusts the distance between the driving device 10 and the guiding device 20 to synchronously control the tension of the transmission rope 30 and keep the tension of the transmission rope 30 constant, thereby reducing the tension fluctuation generated during the operation of the hoisting system and improving the safety of the hoisting system.

In the above embodiment, there are two hydraulic devices 40, and the two hydraulic devices 40 are provided oppositely at the two ends of the guiding device 20. By providing the hydraulic devices 40 at the two ends of the guiding device 20 respectively, the guiding device 20 is more stable, thereby improving the stability of the hoisting apparatus.

In the above embodiment, the hydraulic cylinders 41 of the two hydraulic devices 40 are communicated with each other via an oil pipe 43. By providing the oil pipe 43 to communicate the two hydraulic cylinders 41, the pressures in the two hydraulic cylinders 41 change synchronously, so that the process of regulating the guiding device 20 is smoother.

In the above embodiment, the driving device 10 comprises a hoisting drum 11 and an electric motor 12. The hoisting drum 11 is provided above the wellhead, and part of the transmission rope 30 is wound around the hoisting drum 11. The electric motor 12 is drivingly connected to the hoisting drum 11.

In the above embodiment, the guiding device 20 comprises: a bearing seat 21, a guiding wheel axle 22 and a guiding wheel 23. The bearing seat 21 is provided at the tension regulating device. The guiding wheel axle 22 is rotatably provided in the bearing seat 21. The guiding wheel 23 is nested to the guiding wheel axle 22, and part of the transmission rope 30 is wound around the guiding wheel 23. In a particular embodiment, the two hydraulic devices 40 are provided at the two ends of the guiding wheel axle 22, and the free end of the piston rod 42 is fixedly connected to the bearing seat 21. By providing the piston rods 42 of the hydraulic devices 40 at the two ends of the guiding wheel axle 22 respectively, the regulating process can be smoothly controlled when regulating the tension of the transmission rope 30, thereby improving the stability of the hoisting apparatus.

The rodless chambers of the two hydraulic cylinders 41 provided at the two ends of the guiding wheel axle 22 are connected by the oil pipe 43. The two hydraulic cylinders 41 are controlled by synchronous oil-pressure communication. Under the action of the oil pressure, the piston rods 42 of the two hydraulic cylinders 41 move vertically, to realize the regulation of the transmission rope 30 and keep it constant.

In the above embodiment, the transmission rope 30 comprises a hoisting steel-wire rope 31 and a tail rope 32. The hoisting steel-wire rope 31 has a first end and a second end. The hoisting steel-wire rope 31 is wound around the driving device 10. The first end of the hoisting steel-wire rope 31 is fixedly connected to a counterweight container 51, and the second end of the hoisting steel-wire rope 31 is fixedly connected to a hoisting container 52. The tail rope 32 has a first end and a second end. The tail rope 32 is wound around the guiding device 20. The first end of the tail rope 32 is fixedly connected to the counterweight container 51, and the second end of the tail rope 32 is fixedly connected to the hoisting container 52. The hoisting steel-wire rope 31, the tail rope 32, the counterweight container 51 and the hoisting container 52 are connected to form a ring-shaped transmission structure. By providing the counterweight container 51 and the hoisting container 52, the weight difference between the two sides of the transmission rope 30 can be reduced by changing the weight of the counterweight container 51 or the hoisting container 52, thereby reducing the fluctuating stress of the driving device and improving the transmission efficiency.

In the above embodiment, there are a plurality of transmission ropes 30, the plurality of transmission ropes 30 are wound around the driving device 10 and the guiding device 20, and the plurality of transmission ropes 30 are provided at intervals. Thus, the hoisting apparatus is more steady and reliable.

According to another aspect of the present disclosure, a hoisting system for a mine vertical shaft is further disclosed, comprising: the above-described hoisting apparatus for a mine vertical shaft, a tension detecting device, and a tension controlling device. The tension detecting device is provided at the tension regulating device and is configured to obtain the actual tension value of the transmission rope 30. The tension controlling device is connected to the tension regulating device, the tension controlling device is also connected to the tension detecting device, and the tension controlling device is configured to control the tension regulating device.

According to another aspect of the present disclosure, a method for controlling the above-described hoisting system for a mine vertical shaft is further disclosed, comprising the following steps:

step S10: obtaining an actual tension value F1 of the transmission rope 30 and obtaining a preset tension value F0; and step S20: controlling the tension regulating device to adjust the distance between the driving device 10 and the guiding device 20 according to the actual tension value F1 and the preset tension value F0.

In the above embodiment, the step S20 comprises the following steps:

step S21: when F1>F0, controlling the tension regulating device to reduce the distance between the driving device 10 and the guiding device 20, to reduce the tension of the transmission rope 30; and step S22: when F1<F0, controlling the tension regulating device to increase the distance between the driving device 10 and the guiding device 20, to increase the tension of the transmission rope 30.

In the above embodiment, the step S20 further comprises the following step:

step S23: when the actual tension value F1 is equal to the preset tension value F0, keeping, by the tension regulating device, the distance between the driving device 10 and the guiding device 20 unchanged.

According to another aspect of the present disclosure, a hoisting system for a mine vertical shaft is further disclosed, comprising: the above-described hoisting apparatus for a mine vertical shaft, a pressure detecting device, and a pressure controlling device. The tension regulating device comprises the hydraulic device 40. The pressure detecting device is provided in the hydraulic cylinder 41 of the hydraulic device 40 and configured to obtain an actual pressure value P1 in the hydraulic cylinder 41. The pressure controlling device is connected to the hydraulic device 40, the pressure controlling device is also connected to the pressure detecting device, and the pressure controlling device is configured to control the hydraulic device 40.

According to another aspect of the present disclosure, a method for controlling the above-described hoisting system for a mine vertical shaft is further disclosed, comprising the following steps:

step S10: obtaining an actual pressure value P1 in the hydraulic cylinder 41 and obtaining a preset pressure value P0; and step S20: controlling the hydraulic device 40 to adjust the distance between the driving device 10 and the guiding device 20 according to the actual pressure value P1 and the preset pressure value P0.

In the above embodiment, the step S20 comprises the following steps:

step S21: when P1>P0, controlling the hydraulic device 40 to reduce the distance between the driving device 10 and the guiding device 20, to reduce the tension of the transmission rope 30; and step S22: when P1<P0, controlling the hydraulic device 40 to increase the distance between the driving device 10 and the guiding device 20, to increase the tension of the transmission rope 30.

In the above embodiment, the step S20 further comprises the following step:

step S23: when the actual pressure value P1 is equal to the preset pressure value P0, keeping, by the hydraulic device 40, the distance between the driving device 10 and the guiding device 20 unchanged.

By adopting the above technical solutions, the present disclosure has the following advantages:

(1) The present disclosure is simple in structure, convenient to install and highly practical.

(2) It can adjust the tension value of the transmission rope in real time by moving the piston rod of the hydraulic cylinder under oil-pressure control.

Apparently, the above embodiments of the present disclosure are merely examples to clearly illustrate the present disclosure, and are not intended to limit the embodiments of the present disclosure. For those of ordinary skill in the art, variations or modifications in various forms can be made on the basis of the above description. It is not possible to give an exhaustive list of all embodiments herein. Any obvious variations or modifications derived from the technical solutions of the present disclosure shall still fall within the protection scope of the present disclosure.

What is claimed is:

1. A hoisting apparatus for a mine vertical shaft, comprising:

a driving device provided at a wellhead;

a guiding device provided in a vertical shaft, wherein a position of the guiding device corresponds to a position of the driving device;

a transmission rope wound around the driving device and the guiding device, wherein the driving device is drivingly connected to the guiding device via the transmission rope;

a tension regulating device provided in the vertical shaft, wherein the guiding device is movably provided at the tension regulating device, and the tension regulating device is for regulating a distance between the driving device and the guiding device and the tension regulating device controls a tension of the transmission rope by regulating the distance between the driving device and the guiding device; and wherein the tension regulating device comprises two hydraulic devices provided oppositely at two ends of the guiding device, each of the hydraulic devices comprises a hydraulic cylinder and a piston rod engaged with the hydraulic cylinder, the hydraulic cylinder of the hydraulic device is fixedly provided in the vertical shaft, a free end of the piston rod of the hydraulic device is fixedly connected to the guiding device, and the hydraulic cylinders of the two hydraulic devices communicate with each other via an oil pipe.

2. The hoisting apparatus for a mine vertical shaft according to claim 1, wherein the driving device comprises:

a hoisting drum provided above the wellhead, wherein part of the transmission rope is wound around the hoisting drum; and an electric motor drivingly connected to the hoisting drum.

3. The hoisting apparatus for a mine vertical shaft according to claim 1, wherein the guiding device comprises:

a bearing seat provided at the tension regulating device;

a guiding wheel axle rotatably provided in the bearing seat; and a guiding wheel nested to the guiding wheel axle, wherein part of the transmission rope is wound around the guiding wheel.

4. The hoisting apparatus for a mine vertical shaft according to claim 3, wherein the two hydraulic devices are respectively provided at two ends of the guiding wheel axle, and a free end of the piston rod is fixedly connected to the bearing seat.

5. The hoisting apparatus for a mine vertical shaft according to claim 1, wherein the transmission rope comprises:

a hoisting steel-wire rope wound around the driving device, wherein the hoisting steel-wire rope has a first end and a second end, the first end of the hoisting steel-wire rope is fixedly connected to a counterweight container, and the second end of the hoisting steel-wire rope is fixedly connected to a hoisting container; and a tail rope wound around the guiding device, wherein the tail rope has a first end and a second end, the first end of the tail rope is fixedly connected to the counterweight container, the second end of the tail rope is fixedly connected to the hoisting container, and the hoisting steel-wire rope, the tail rope, the counterweight container and the hoisting container are connected to form a closed-loop shaped transmission structure.

6. The hoisting apparatus for a mine vertical shaft according to claim 1, wherein there are a plurality of transmission ropes wound around the driving device and the guiding device, and the plurality of transmission ropes are provided separately.

7. A method for controlling a hoisting system for a mine vertical shaft, wherein the hoisting system for a mine vertical shaft comprising:

a driving device provided at a wellhead;

a guiding device provided in a vertical shaft, wherein a position of the guiding device corresponds to a position of the driving device;

a transmission rope wound around the driving device and the guiding device, wherein the driving device is drivingly connected to the guiding device via the transmission rope; and a tension regulating device provided in the vertical shaft, wherein the guiding device is movably provided at the tension regulating device, and the tension regulating device is for regulating a distance between the driving device and the guiding device and the tension regulating device controls a tension of the transmission rope by regulating the distance between the driving device and the guiding device;

wherein the tension regulating device comprises two hydraulic devices provided oppositely at two ends of the guiding device, each of the hydraulic devices comprises a hydraulic cylinder and a piston rod engaged with the hydraulic cylinder, the hydraulic cylinder of the hydraulic device is fixedly provided in the vertical shaft, a free end of the piston rod of the hydraulic device is fixedly connected to the guiding device, and the hydraulic cylinders of the two hydraulic devices communicate with each other via an oil pipe;

a tension detecting device configured to obtain an actual tension value of the transmission rope; and a tension controlling device connected to the tension regulating device and the tension detecting device and configured to control the tension regulating device;

wherein the method comprises the following steps:

obtaining an actual tension value F1 of the transmission rope and obtaining a preset tension value F0; and controlling the tension regulating device to adjust the distance between the driving device and the guiding device according to the actual tension value F1 and the preset tension value F0.

8. The method for controlling the hoisting system for a mine vertical shaft according to claim 7, wherein the step of controlling the tension regulating device comprises:

when F1>F0, controlling the tension regulating device to reduce the distance between the driving device and the guiding device, to reduce the tension of the transmission rope; and when F1<F0, controlling the tension regulating device to increase the distance between the driving device and the guiding device, to increase the tension of the transmission rope.

9. The method for controlling the hoisting system for a mine vertical shaft according to claim 8, wherein the step of controlling the tension regulating device further comprises:

when the actual tension value F1 is equal to the preset tension value F0, keeping, by the tension regulating device, the distance between the driving device and the guiding device unchanged.

10. The method for controlling the hoisting system for a mine vertical shaft according to claim 7, wherein there are a plurality of transmission ropes that are wound around the driving device and the guiding device, and the plurality of transmission ropes are provided separately;

wherein each transmission rope comprises:

a hoisting steel-wire rope wound around the driving device, wherein the hoisting steel-wire rope has a first end and a second end, the first end of the hoisting steel-wire rope is fixedly connected to a counterweight container, and the second end of the hoisting steel-wire rope is fixedly connected to a hoisting container; and a tail rope wound around the guiding device, wherein the tail rope has a first end and a second end, the first end of the tail rope is fixedly connected to the counterweight container, the second end of the tail rope is fixedly connected to the hoisting container, and the hoisting steel-wire rope, the tail rope, the counterweight container and the hoisting container are connected to form a closed-loop shaped transmission structure.

11. A method for controlling a hoisting system for a mine vertical shaft, wherein the hoisting system for a mine vertical shaft comprising:

a driving device provided at a wellhead;

a guiding device provided in a vertical shaft, wherein a position of the guiding device corresponds to a position of the driving device;

a transmission rope wound around the driving device and the guiding device, wherein the driving device is drivingly connected to the guiding device via the transmission rope; and a tension regulating device provided in the vertical shaft, wherein the guiding device is movably provided at the tension regulating device, and the tension regulating device is for regulating a distance between the driving device and the guiding device and the tension regulating device controls a tension of the transmission rope by regulating the distance between the driving device and the guiding device; and wherein the tension regulating device comprises two hydraulic devices provided oppositely at two ends of the guiding device, each of the hydraulic devices comprises a hydraulic cylinder and a piston rod engaged with the hydraulic cylinder, the hydraulic cylinder of the hydraulic device is fixedly provided in the vertical shaft, and a free end of the piston rod of the hydraulic device is fixedly connected to the guiding device, the hydraulic cylinders of the two hydraulic devices communicate with each other via an oil pipe;

a pressure detecting device provided in the hydraulic cylinder of the hydraulic device and configured to obtain an actual pressure value in the hydraulic cylinder; and a pressure controlling device connected to the hydraulic device and the pressure detecting device, and configured to control the hydraulic device, wherein the method comprises the following steps:

obtaining an actual pressure value P1 in the hydraulic cylinder and obtaining a preset pressure value P0; and controlling the hydraulic device to adjust the distance between the driving device and the guiding device according to the actual pressure value P1 and the preset pressure value P0.

12. The method for controlling the hoisting system for a mine vertical shaft according to claim 11, wherein the step of controlling the hydraulic device comprises:

when P1>P0, controlling the hydraulic device to reduce the distance between the driving device and the guiding device, to reduce the tension of the transmission rope; and when P1<P0, controlling the hydraulic device to increase the distance between the driving device and the guiding device, to increase the tension of the transmission rope.

13. The method for controlling the hoisting system for a mine vertical shaft according to claim 12, wherein the step of controlling the hydraulic device further comprises:

when the actual pressure value P1 is equal to the preset pressure value P0, keeping, by the hydraulic device, the distance between the driving device and the guiding device unchanged.

14. The method for controlling the hoisting system for a mine vertical shaft according to claim 11, wherein the guiding device comprises:

a bearing seat provided at the tension regulating device;

a guiding wheel axle rotatably provided in the bearing seat;

a guiding wheel nested to the guiding wheel axle, wherein part of the transmission rope is wound around the guiding wheel; and the two hydraulic devices are respectively provided at two ends of the guiding wheel axle, and a free end of the piston rod is fixedly connected to the bearing seat.

* * * * *